US007191980B2

(12) United States Patent
McGovern et al.

(10) Patent No.: US 7,191,980 B2
(45) Date of Patent: Mar. 20, 2007

(54) WEB-WINDING DEVICE

(75) Inventors: Michael R. McGovern, Rochester, NY (US); Edgar G. Earnhart, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/719,444

(22) Filed: Nov. 21, 2003

(65) Prior Publication Data

US 2005/0139725 A1 Jun. 30, 2005

(51) Int. Cl.
*B65H 75/14* (2006.01)

(52) U.S. Cl. ..... 242/610; 242/610.4; 242/610.6

(58) Field of Classification Search ..... 242/610, 242/610.4, 610.5, 610.6, 118.7
See application file for complete search history.

(56) References Cited

U.S. PATENT DOCUMENTS 4,042,399 A 8/1977 Kiesslich
4,049,861 A 9/1977 Nozari
4,749,617 A 6/1988 Canty
4,767,186 A 8/1988 Bradley, Jr. et al.
5,144,474 A 9/1992 Keable et al.
5,414,032 A 5/1995 Akao et al.
5,694,629 A 12/1997 Stephenson, III et al.
5,873,543 A 2/1999 Schneider et al.
6,042,048 A 3/2000 Czuprynski et al.

*Primary Examiner*—John Q. Nguyen
(74) *Attorney, Agent, or Firm*—Clyde E. Bailey; Paul A. Leipold

(57) ABSTRACT

An improved web-winding means with a durable thermoplastic polyester resin or polyester resin blend support structure and web capture slot (gate) formed in an interior portion of the support structure. The interior portion is joined to an inner annular surface that has increased lubricity, toughness and creep resistance resulting in decreased debris generation plus increased structural integrity and dimensional stability.

18 Claims, 8 Drawing Sheets

| SPI FINISH | FINISH TYPE | MOLD TEXTURE (RA MICRONS, MEASURED) | COEFFICIENT OF FRICTION | | | |
|---|---|---|---|---|---|---|
| | | | (+2 STD) | (-2 STD) | AVG. | STD |
| HIPS (NOVACOR "5104") | 600 GRIT PAPER | 0.10 | 0.63 | 0.53 | 0.58 | 0.027 |
| A1 | #3 DIAMOND BUFF | 0.02 | 0.32 | 0.28 | 0.30 | 0.012 |
| A3 | #15 DIAMOND BUFF | 0.04 | 0.28 | 0.24 | 0.26 | 0.01 |
| D2E | EDM, CHARMILLES 18 | 0.80 | 0.29 | 0.23 | 0.26 | 0.015 |
| B1 | 600 GRIT PAPER | 0.10 | 0.24 | 0.18 | 0.21 | 0.017 |
| D1 | #12 GLASS BEAD | 0.37 | 0.24 | 0.18 | 0.21 | 0.017 |
| C3 | 320 STONE | 0.29 | 0.25 | 0.17 | 0.21 | 0.021 |
| D2 | #10 GLASS BEAD | 0.37 | 0.26 | 0.16 | 0.21 | 0.025 |
| C1 | 600 STONE | 0.32 | 0.21 | 0.17 | 0.19 | 0.01 |
| B3 | 320 GRIT PAPER | 0.23 | 0.21 | 0.15 | 0.18 | 0.015 |
| D3 | EDM, CHARMILLES 24 | 1.57 | 0.2 | 0.1 | 0.15 | 0.026 |

| | HIPS NOVA "5104" | PBT GE "VALOX 325" |
|---|---|---|
| TENSILE ELEONGATION | 55% | 200% |
| FLEXURAL STRENGTH | 62 MPa | 83 MPa |
| TENSILE STRENGTH | 27 MPa | 52 MPa |
| FLEXURAL MODULUS | 2,300 MPa | 2,300 MPa |

WEB-WINDING DEVICE

CROSS-REFERENCE TO RELATED APPLICATIONS

The present application is related to U.S. Ser. No. 10/719,120, filed concurrently herewith, of Michael R. McGovern and Edgar G. Earnhart, entitled "A Web-Winding Means", and U.S. Ser. No. 10/719,578, filed concurrently herewith, of Michael R. McGovern and Edgar G. Earnhart, entitled "Method Of Manufacturing A Web-Winding Device".

FIELD OF THE INVENTION

The invention relates generally to the field of web-winding devices. More particularly, the invention concerns a web-winding means particularly well suited for photographic film material based on silver halide technology.

BACKGROUND OF THE INVENTION

Traditionally, motion picture film stock cores, such as those defined by the Society of Motion Picture and Television Engineers (SMPTE) standard ANSI-SMPTE 37M or ISO 1039-1995, have been injection molded from thermoplastic high impact polystyrene (HIPS) molding compounds. The HIPS resin has been the material of choice mostly driven by cost, ease of injection molding, and suitability for the state of motion picture film production and cinema projection technology. Cores produced from HIPS resins have been used to produce motion picture cores from multi-cavity tools or molds now for over forty years.

Over time the total amount (as measured in length) of motion picture film and the tightness of wrap (with a resultant hoop stress on the core) has increased. The spooling process (manufacturing and printing) has evolved into a high-speed process where motion picture film is spooled at a speed of thousands of meters per minute to achieve greater productivity rates. A result of these improvements is a finished core product with a much greater weight and stress but with no change in the basic design of the motion picture core to compensate. Moreover, the demands of cinematographers for low light sensitive films and the demands from consumers for high-quality theatre experience have increased demands for film cleanliness in raw stock and printing production. The high speed of the spooling process combined with the poor overall wear property of the current thermoplastic HIPS resin result in the generation of a tremendous amount of HIPS dust and debris at the mounting interface of the core with the winding machine spindle. The generation of this level of debris creates high production losses and nightmarish housekeeping issues. The present invention resolves all of these issues plus creates an opportunity of reuse of cores which was never done with the HIPS resins due to the potential of damage from handling, transportation and use. Core crush, a form of permanent deformation, is exemplary of the damage from handling where a fully spooled motion picture core sustains sufficient impact energy to literally crush the core resulting in complete failure of the part. Needless to say, this form of damage is particularly costly and frustrating to motion picture printing customers because: 1) film telescopes and comes off of whatever is left of the damaged core; and/or 2) the core cannot be installed onto the winding spindle.

There have been several attempts in the art to solve aspects of the above problems. In U.S. Pat. No. 4,042,399 by Kiesslich teaches the disclosure of a photographic element having improved slip. However, a shortcoming of this development is that the surface of the photographic element is required to be coated with a polyester film to improve slip.

Another prior art film transport development is described in U.S. Pat. No. 5,694,629 by Stephenson, III et al. The transport mechanism of Stephenson uses slip clutches made of polycarbonate to improve slip.

In U.S. Pat. No. 4,049,861 by Nozari a web-winding device is disclosed that requires the use of abrasion resistant coatings including polyesters and polycarbonates to reduce web slippage.

Therefore, a need persists in the art for a web-winding means that has a mounting surface with substantially reduced friction, is substantially damage resistant, and does not generate deleterious debris during typical web-winding and unwinding operations.

SUMMARY OF THE INVENTION

It is, therefore, one object of the invention to provide a web-winding means that is far more durable and less debris generating than existing developments.

Another object of the invention is to provide a web-winding means that have far superior mechanical integrity than prior art models.

Yet another object of the invention is to provide a method of making a web-winding means that is far more durable and generates less debris than existing devices.

The present invention is directed to overcoming one or more of the problems set forth above. Briefly summarized, according to one aspect of the present invention, a web-winding device has a generally cylindrical support structure having an outer web wrapping surface for receiving at least one convolution of a web, an inner annular surface joined to said support structure for mating with a web-winding machine, wherein said inner annular surface has a wear rate coefficient of less than about $3.0\times10^{-7}$ $m^3/Nm$.

The web-winding means of the present invention has numerous advantages over prior developments, including: substantially improved overall mechanical properties; a stronger core to withstand the higher hoop stress and resist core crush; lower friction and wear which results in a significant reduction in airborne debris that results in product contamination issues and ability to reuse cores; and an enhancement in the surface finish of the working surface of the core that comes into contact with the film which facilitates the cinching of the leader portion of the film.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
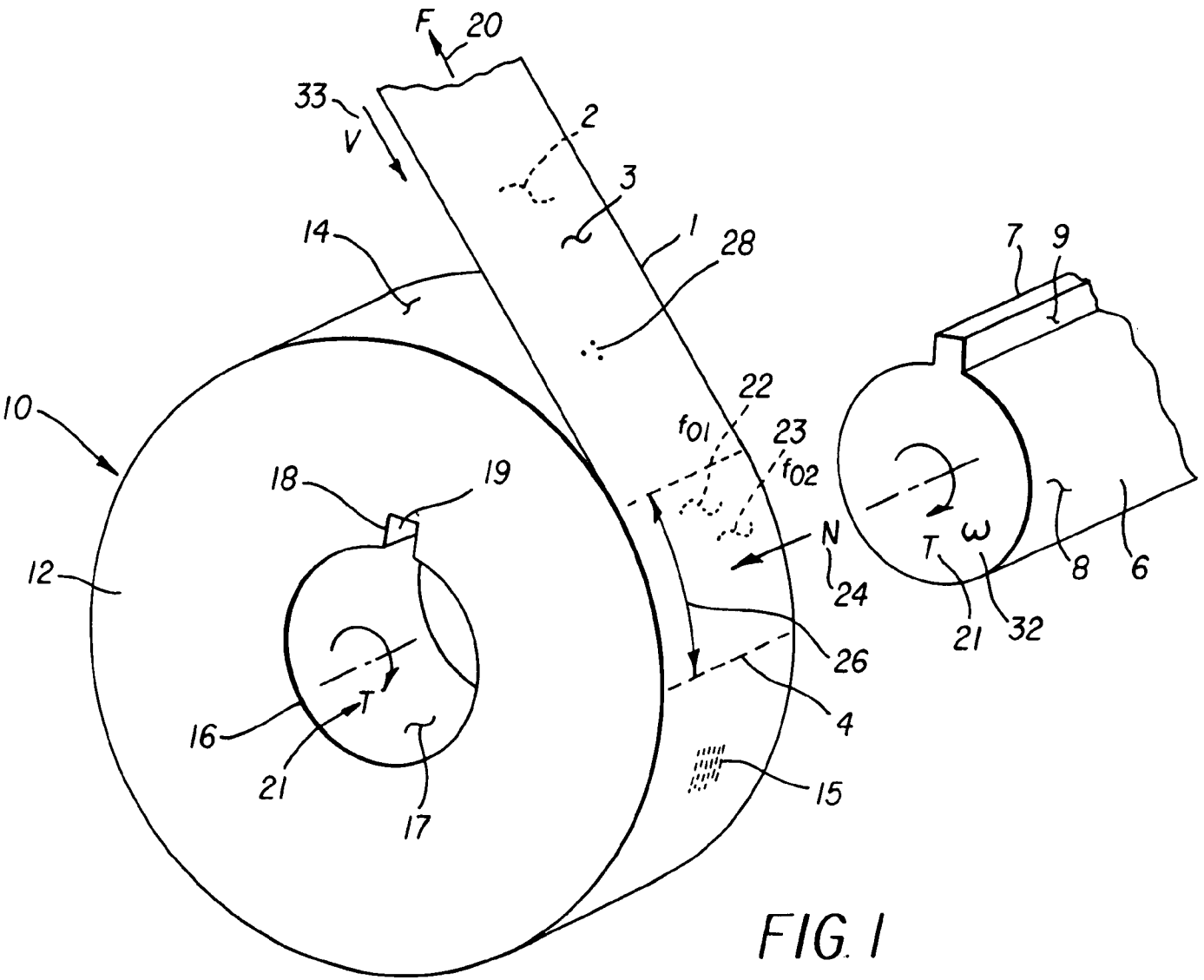
FIG. 1 is an isometric view of the web-winding means of the invention with cinch attachment of web to winding means.

Referring now to the drawings, and particularly to FIG. 1, the web-winding means 10 of the invention is illustrated. According to FIG. 1, the web-winding means 10, broadly defined, includes a generally cylindrical support structure 12. The support structure 12 has an outer web wrapping surface 14 with surface texture 15 for receiving by cinching overlap 26 at least one convolution of a web 1. Skilled artisans will appreciate that web 1 has an interior surface 2, an exterior surface 3, a web end 4, and an annular portion 16 for mounting onto a web-winding machine spindle 6. A keyway 18 is provided in the annular portion 16 to engage spindle key 7 of the web-winding means for transmitting applied torque 21 generated by the web-winding means and spindle rotation speed 32. It is well known that cinching attachment of the web to the winding means is a function of the cinching force 24 and the static coefficient of friction for interior surface of web to web wrapping surface 22. It is also well known that the static coefficient of friction 22 for interior surface of web to web wrapping surface is a function of the material of the web-winding means 10, the material of the web 1, and texture of web wrapping surface 15.

Referring again to FIG. 1, failure to cinch occurs when the static coefficient of friction for interior surface of web to web wrapping surface 22 is less than the static coefficient of friction for interior surface of web to exterior surface of web 23.

Referring again to FIG. 1, deleterious particles 28 are generated from the annular portion surface by the abrasion of the annular portion surface 17 against the spindle surface 8 and the web winding machine spindle key surfaces 9 are against the key way surface 19. The abrasion results from minute movements of web-winding device 10 relative to the spindle 6 due to the dynamics of the web-winding process. The deleterious particles 28 are predominantly generated from but not limited to the web-winding device 10 being typically composed of a material with a lower abrasion resistance than that of the spindle 6. Web- winding machine spindle 6 is typically composed of AISI type 316 Stainless Steel in photographic web applications.

Referring again to FIG. 1, failure of the web-winding means 10 occurs when: a) web-winding means 10 cannot be removed from web-winding machine spindle 6 after web-winding process or, b) web-winding means cannot be reinstalled on a web-winding machine spindle 6 set to run in reverse direction to unwind web for use of web in subsequent process. At the end of the web-winding process, the trailing web end is secured in place typically with a piece of tape. Thus retaining at least partial web tension 20 and resulting cinching force 24. The resulting compressive stresses in the web device support structure 12 results in a reduction in the size of the annular portion 16 as a function of the geometry and elastic modulus properties of the material composed in the support structure 12. In the case of a web-winding device 10 composed of plastic materials, the size of the annular portion 16 becomes even smaller with time after completion of web-winding process due to plastic creep under said compressive stresses. Mechanical failure of the web-winding means 10 may also occur due to the said compressive stresses. Therefore it is obvious that the geometry of the support structure 12 as well as the elastic modulus, and compressive strength are important factors in consideration of the design of a web-winding means.

Figure 2:
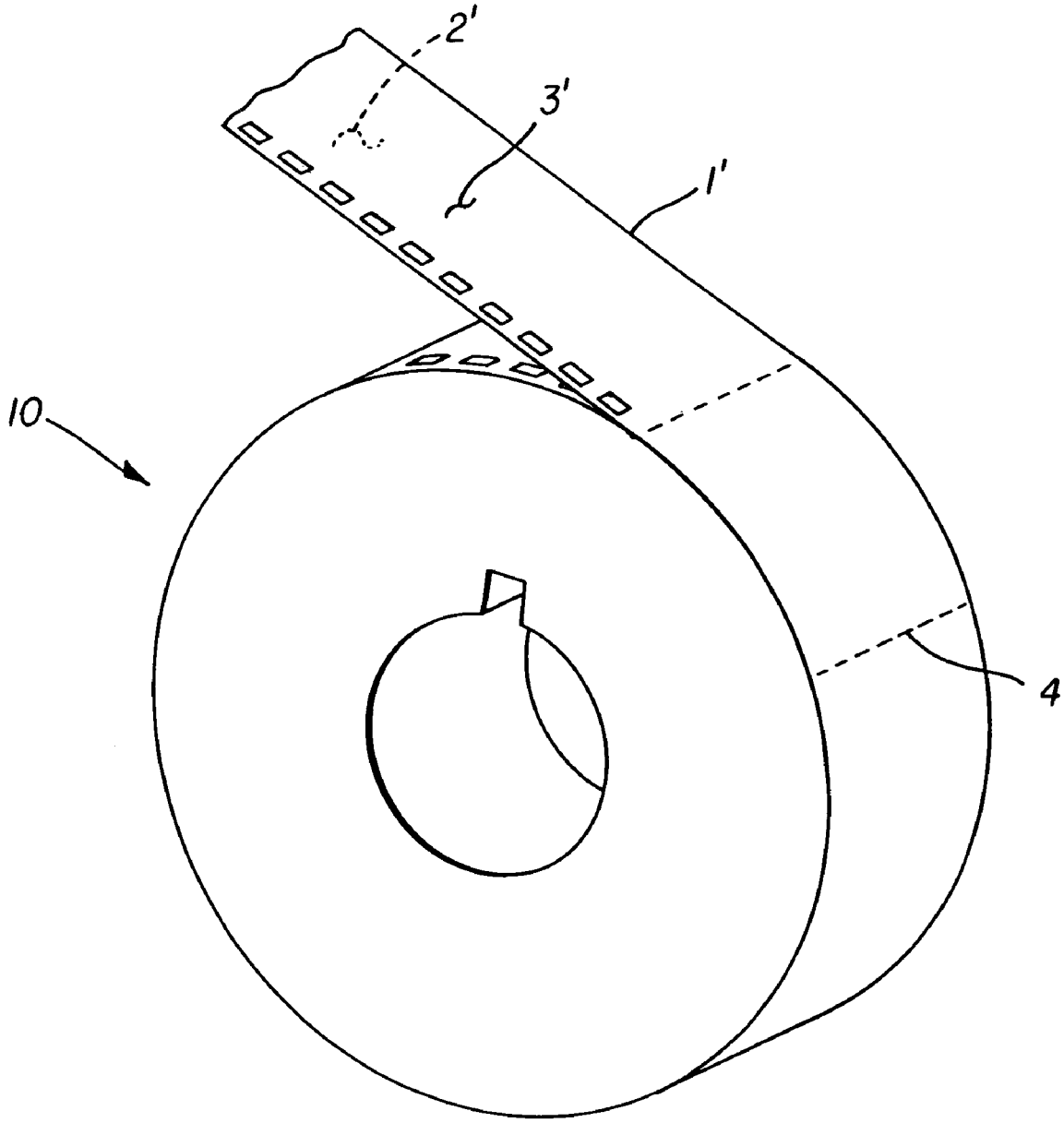
FIG. 2 is an isometric view of the web-winding means of the invention for photographic web as described by ANSI-SMPTE 37 M or ISO 1039-1995 with cinch attachment of web to winding device.

Referring to FIG. 2, a further embodiment of the web-winding means of FIG. 1 is illustrated where the material being wound is any photographic web 1' with an emulsion layer side and a support layer side. Of particular note, in this embodiment, is that the interior surface of web 2 is an emulsion side surface 2' and the exterior surface of web 3 is a support side surface 3'.

Figure 3:
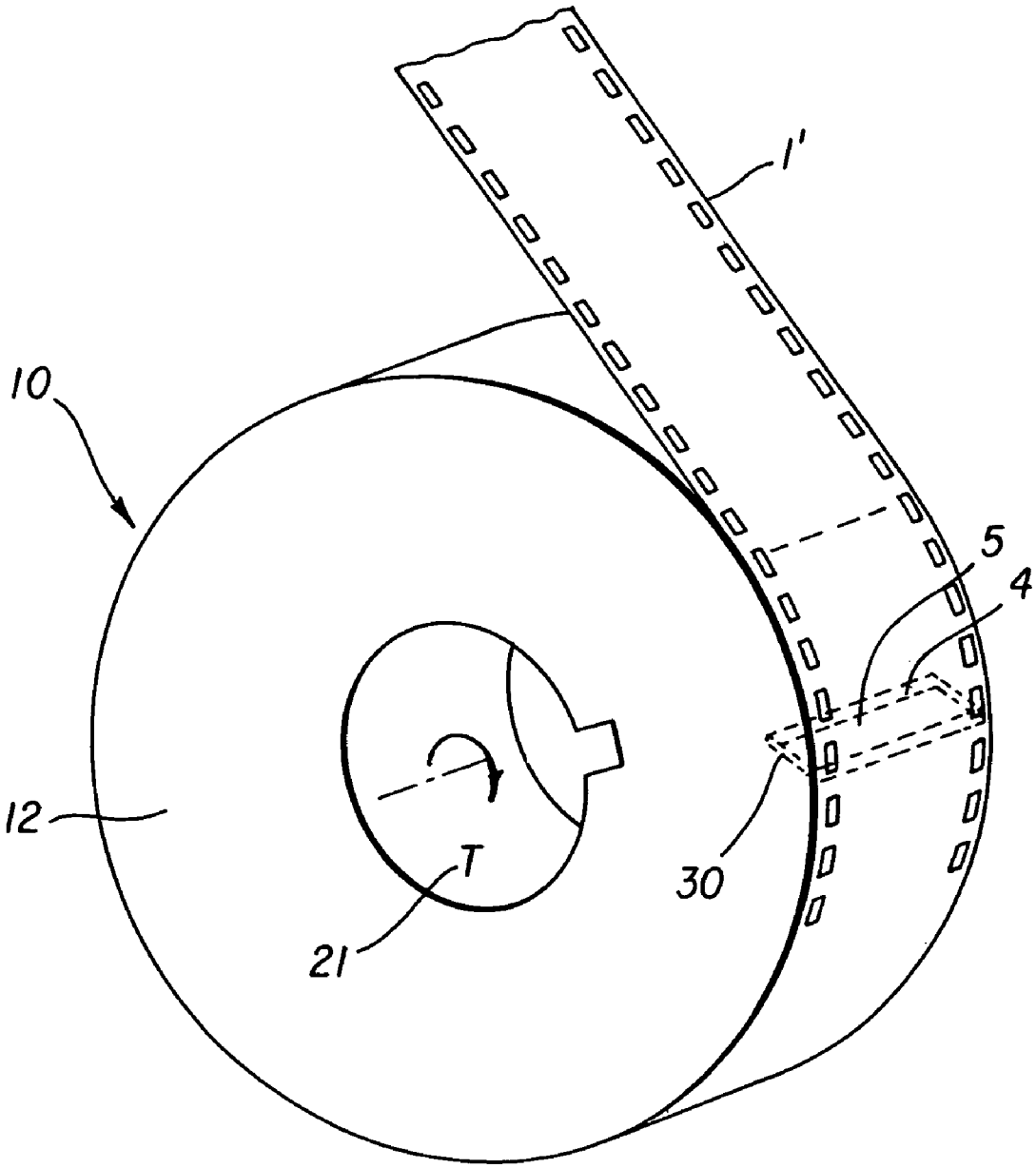
FIG. 3 is an isometric view of the web-winding means of the invention with a web capture gate attachment to the winding device.

Referring to FIG. 3, in yet another embodiment of the invention shown in FIGS. 1 and 2, an alternate means of attaching the web 1 to the web-winding means 10 is depicted. In this embodiment, the web-winding means 10 comprises a web capture gate 30 formed in an interior portion of the support structure 12 secures a web end portion 5 of the web 1 in the support structure 12 prior to the web 1 being wrapped along the outer web wrapping surface 14. The web end 4 is then further secured by at least 1 convolution of web 1 thus transmitting the web machine applied torque 21.

It is apparent that the solution to the current problems associated with a web-winding device 10 as described in the previous Figures requires a material with: a) static coefficient of friction between web-winding device surface and inner web surface comparable to current developments; b) lower deleterious particle generation between annular portion surface and web-winding machine spindle surface than current developments; c) higher elastic modulus than current developments; and d) lower plastic creep than current developments.

Figure 4:
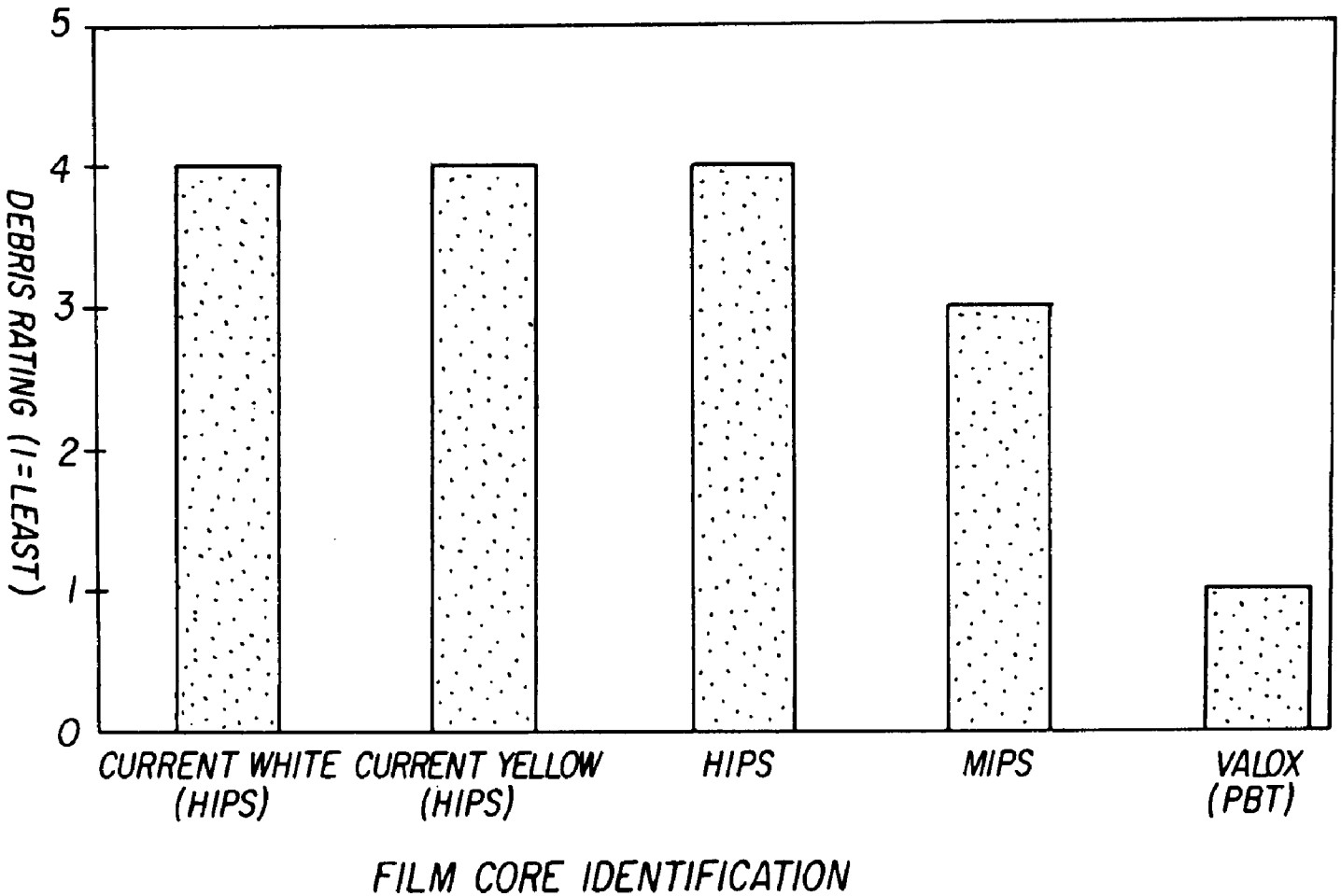
FIG. 4 is chart of a qualitative assessment of debris accumulation for various materials.

FIG. 4 depicts an example of quantitative experimental results of a study of deleterious particle generation or volume loss of photographic film cores produced of various materials against an AISI type 316 stainless steel block. According to FIG. 4, a web-winding device composed of PBT material had substantially less deleterious particle generation (volume loss) than the current development.

Figure 5A:
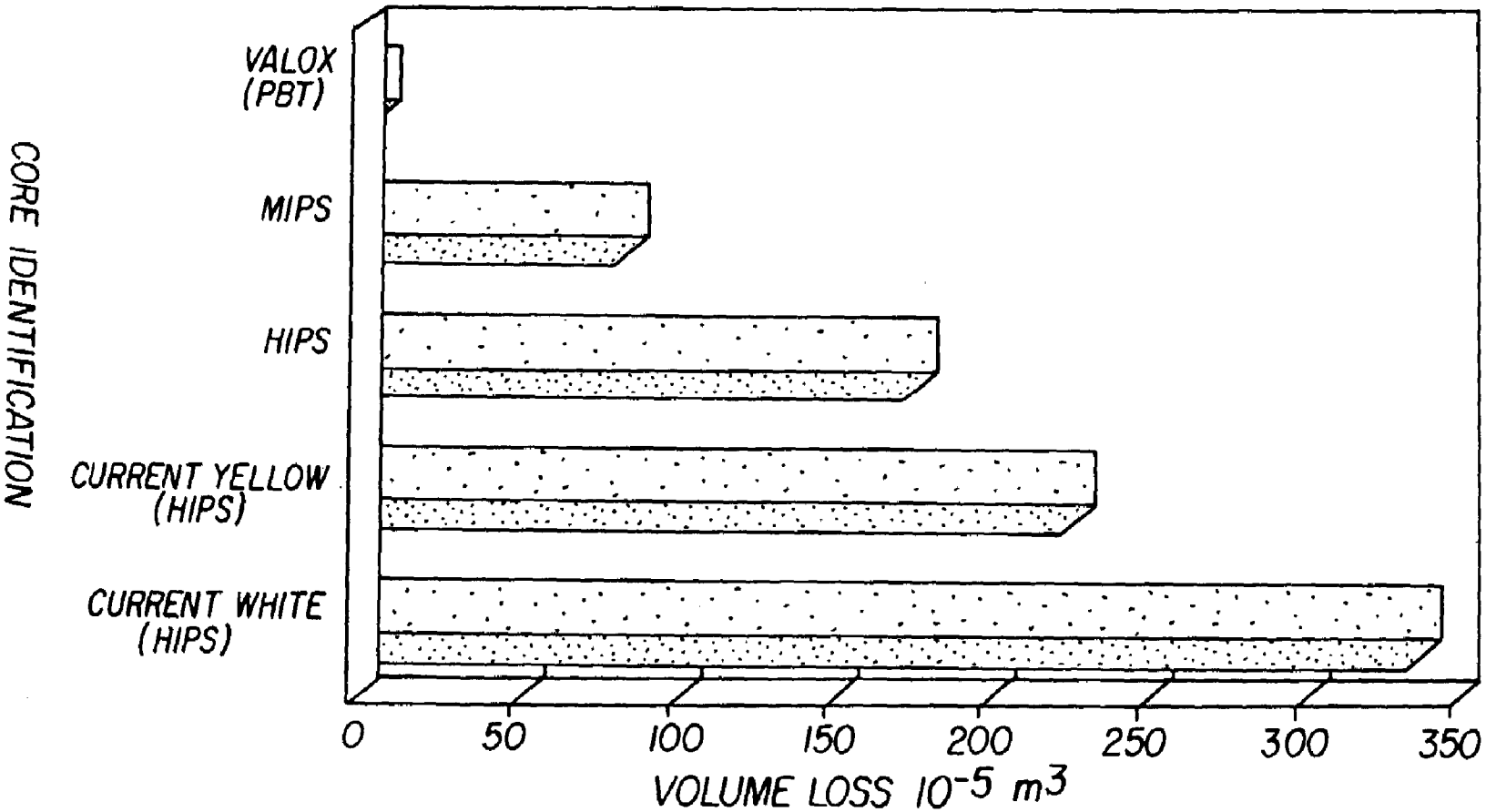
FIGS. 5(*a*) and 5(*b*) are charts of a quantitative assessment of debris generated from film cores of various materials.
Figure 5B:
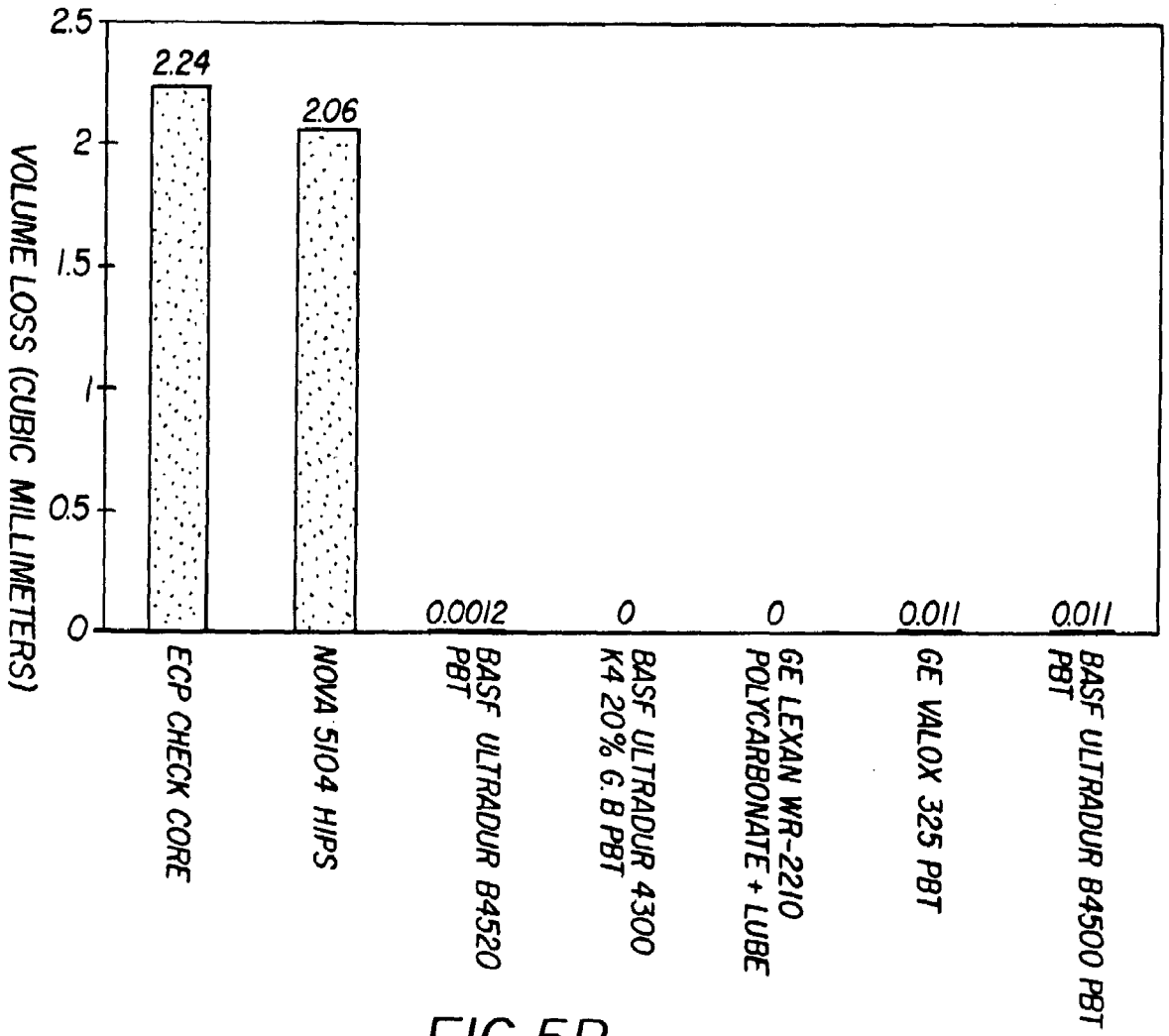

Referring to FIGS. 5(*a*) and 5(*b*), examples are shown of quantitative experimental results of studies of volume loss of various materials from web-winding means 10 (as shown in FIG. 1) against AISI type 316 stainless steel balls used to represent spindle 6. According to FIG. 5(*a*), a web-winding device composed of PBT material had substantially less deleterious particle generation (volume loss) than prior art developments. According to FIG. 5(*b*), the same web-winding device above had substantially less deleterious particle generation (volume loss) than prior art development when a series of different semi-crystalline polyester and polyester blends, including lubricants and fillers, are used to produce web-winding means 10.

Referring to Table I below, wear rate coefficients are calculated based on the volume loss measurements discussed in FIG. 5(*b*). Therefore, wear rate coefficient $k=V/(F*s)$, where (V) is volume loss, F is force applied against the steel balls (spindle 6) and (s) is the stroke of motion of steel balls. The results show that the wear rate coefficient k for the preferred materials in FIG. 5(*b*) are at least a factor of two less than that of the prior art developments.

Wear Rate Coefficient Test Results

| Core Material | Volume Loss V $m^3$ | Force F N | Stroke s m | Wear Rate Coefficient k $m^3/Nm$ |
|---|---|---|---|---|
| ECP Check Core (HIPS) | 2.240E−06 | | | 4.497E−05 |
| NOVA 5104 HIPS | 2.060E−06 | | | 4.136E−05 |
| BASF Ultradur B4520 PBT | 1.200E−09 | | | 2.409E−08 |
| BASF Ultradur 4300 K4 20% G.B. PBT | 0.000E+00 | 1.961 | 0.0254 | 0.000E+00 |
| GE Lexan WR-2210 PC + Lube | 0.000E+00 | | | 0.000E+00 |
| GE Valox 325 PBT | 1.100E−08 | | | 2.208E−07 |
| BASF Ultradur B4500 PBT | 1.100E−08 | | | 2.208E−07 |

$K = V/(F \cdot s)$

Figure 6:
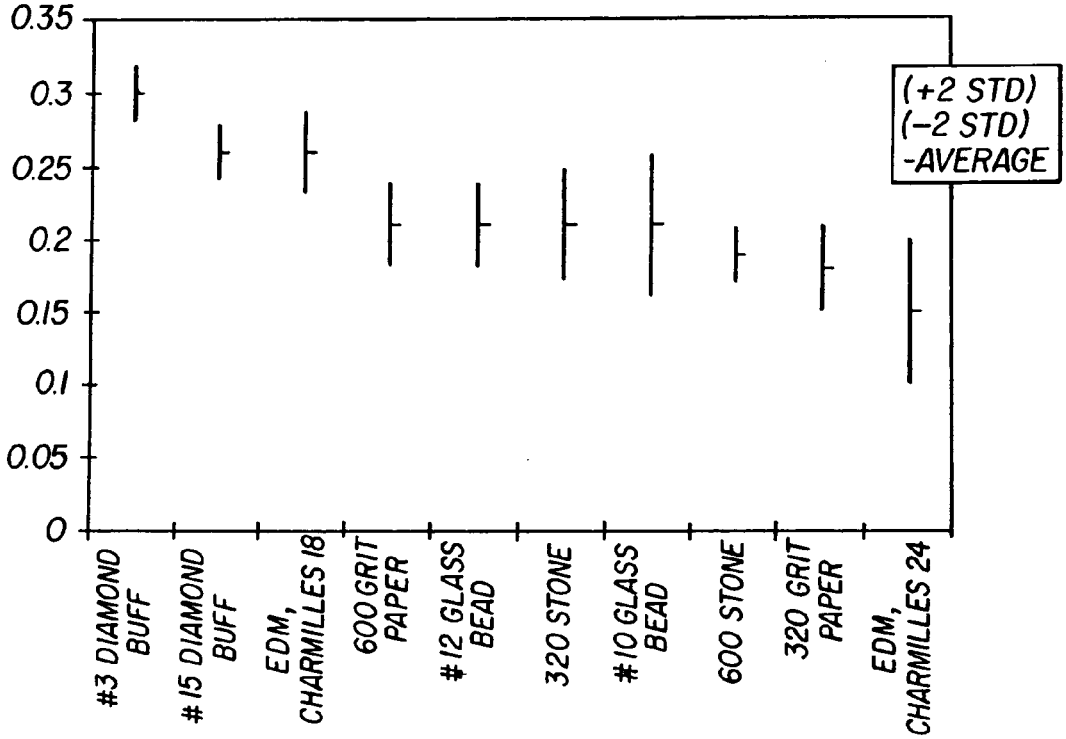
FIG. 6 is a chart of static coefficient of friction of the emulsion side of a photographic web against a PBT sample with various surface textures.

Referring to FIG. 6, experimental results are illustrated of a study of the coefficient of friction of photographic web emulsion side against unfilled polybutylene terphthalate (PBT) with various surface textures. According to FIG. 6 the static coefficient of friction is inversely related to the coarseness of the surface texture with the highest values obtained as the surface finish approaches a mirror finish.

Figures 7, 8:
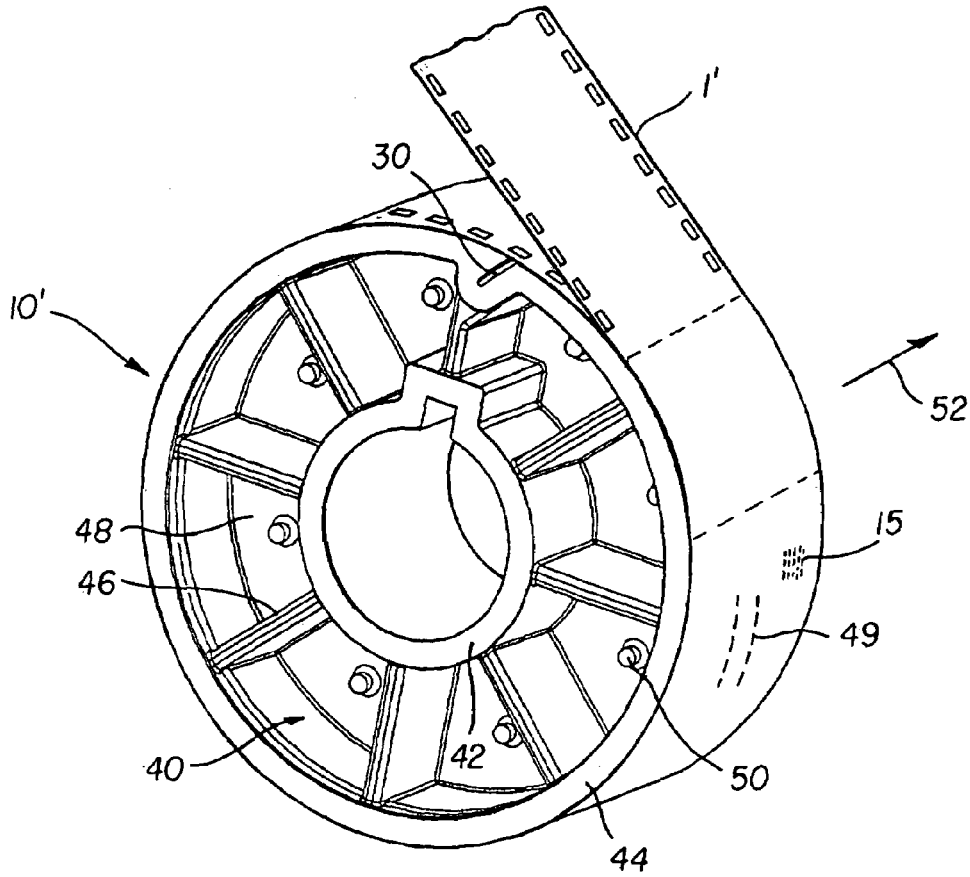
FIG. 7 is a chart of mechanical property comparison between HIPS and PBT.
FIG. 8 is an isometric view of the preferred embodiment.

Referring to FIG. 7, comparative mechanical property data is depicted between an unfilled high impact polystyrene (Nova "5104") and an unfilled polybutylene terphthalate (GE "Valox 325"). The data clearly indicates that the PBT material has higher stress yield and lower plastic creep properties than HIPS.

Referring to FIG. 8, web-winding means 10' has a support structure 12 injection molded preferably from a family of thermoplastic injection molding grades of polyester or polyester blends. In particular advantages are identified with the use of semi-crystalline thermoplastic polyester or polyester blends that will result in reduced debris generation, lower deleterious particle generation for a molded motion picture film core exhibiting less plastic creep and higher toughness. As a further refinement of this invention, it is noted that in particular, a semi-crystalline thermoplastic polyester resin in the polybutylene terphthalate (PBT) family has yielded the best overall advantages detailed in previous sections of this application. One example of such a PBT thermoplastic semi-crystalline resin is the General Electric polyester product family listed under the trade name of "Valox". Further still, the authors identify that the neat or unfilled General Electric PBT semi-crystalline thermoplastic resin grade of "Valox 325" natural is a prime candidate for this injection molded motion picture core application. The General Electric line of the "Valox PBT" resins offers good dimensional stability, good chemical resistance, high surface gloss if desired, good fatigue endurance and excellent lubricity.

Injection molded motion picture cores formed from the materials above will be produced from semi-crystalline PBT resin with a typical specific gravity (solid) of 1.31 grams per cubic centimeter with an intrinsic viscosity between 5000 to 6000 poise.

The antioxidant (AO) package that is very common for PBT resins is a typical combination of a primary AO such as a sterically hindered phenol (2,6-Di-tert. butyl-p-cresol from the alkylidene-bisphenols family) in conjunction with a secondary AO component such as from the phosphite or phosphonite group both of which are short-chained organics. Typical levels of the AO package range from 0.20% to 1.0% by weight with a preferred aim weight percent of 0.5.

Described film cores have a generally cylindrical support structure having an outer web wrapping surface for receiving at least one convolution of a web; an annular portion with a keyway for mounting a core onto a film winding machine and transmitting torque thru the core to the film for wind tension; a support structure a web capture slot (gate) for securing a portion of the web in said support structure prior to the web being wrapped along the web wrapping surface; sensible features in the support structure for determination of orientation when mounting on a film winding machine for the purpose of correct web capture slot orientation; and a web wrapping surface capable of providing a cinch wrap engagement of the film to the web wrapping surface that allows winding of film to the core without use of the web capture slot.

EXAMPLES

The following are exemplary of the web-winding means of the invention composing a 0.5% by weight AO modified PBT resin formulations.

In accordance with Example 1, web-winding means 10 is composed of 4,4'-Di-tert-octyldiphenylamine.

In accordance with Example 2, web-winding means 10 of the invention is composed of pentaerythrityl tetrakis-3-(3,5-Di-tert-butyl-4-hydroxyphenyl)-proprionate.

In accordance with Example 3, web-winding means 10 of the invention is composed of pentaerythrityl tetrakis-3-(3,5-Di-tert-butyl-4-hydroxyphenyl)-propionate with N,N'-hexamethylenebis-3-(3,5-Di-tert-butyl-4-hydroxyphenyl)-propionamide.

In each of the above examples, typical mechanical properties for this PBT grade resin include:

(1) tensile strength at break (Type I) at 3.2 mm thick tensile bar is about 50 Mega Pascals per ASTM D 638;

(2) tensile elongation at yield (Type I) at 3.2 mm thick tensile bar is about 200 percent per ASTM D 638;

(3) flexural strength at break at 3.2 mm is about 12,000 psi (80 Mega Pascals) per ASTM D 790;

(4) flexural modulus at 3.2 mm is about 2,300 Mega Pascals per ASTM D 790; and, (5) Rockwell (R scale) hardness is about 117 per the ASTM D 785.

Alternative suitable materials for an injection molded web-winding device 10 of the invention include:

(1) Polybutylene terphthalate/polycarbonate (PBT/PC) blends. Examples are: GE Plastics "Xenoy 5200" and "Xenoy 1200";

(2) Polybutylene terphthalate/polycarbonate-silicone copolymers.

Example

GE Plastics "LEXAN EXL"; and (3) PTFE filled polycarbonate (amorphous polyester).

Examples

GE Plastics "LEXAN WR2210" with 15 percent by weight PTFE.

Referring to FIG. 8, the preferred embodiment of this invention comprises an injection molded web-winding means 10' for a photographic web 1' comprised of a plurality of cored segments 40 forming an outer web-winding surface wall thickness 44, an inner annular portion wall thickness 42, and a plurality of support ribs 46, and a outer web-winding surface to inner annular portion surface connecting portion 48 with a wall thickness 49. The web-winding means 10 preferably conforms to dimensions per ISO international standard ISO 1039 "Cinematography—Cores for Motion-Picture And Magnetic Film Rolls—Dimensions" and the equivalent standard ANSI/SPTME 37M "SMPTE Standard for Motion-Picture Equipment—Raw Stock Cores". In particular the preferred embodiment for the invention is a 35 mm×75 mm motion-picture raw stock core. Outer web-winding surface wall thickness 44, the inner annular portion surface wall thickness 42 and the connecting portion wall thickness 49 are substantially identical with a value of about 3.6 mm. The preferred thickness of support rib 46 is about 2.9 mm.

Referring again to FIG. 8, the preferred embodiment of the invention comprises a said injection molded web-winding device for a photographic web 1' comprised of neat or unfilled natural GE Plastics "Valox 325" semi-crystalline thermoplastic polybutylene terphthalate (PBT), and texture 15 of web-winding surface 14 has a maximum value of 0.03 micron Ra with a lay parallel to the wrapping direction of the web.

Referring yet again to FIG. 8, the preferred embodiment of the invention comprises a said injection molded web-winding means 10' for a photographic web 1' comprising a web capture gate. The web capture gate 30 is about 1.3 mm wide by about 6.6 mm deep with an angle of incidence of about 45 degrees to the web wrapping surface 14.

Referring again to FIG. 8, the preferred embodiment of the invention comprises an injection molded web-winding means 10' for a photographic web 1' comprising a plurality of sensible features 50 to ensure proper orientation of film capture gate to web-winding machine mounting direction 52 in darkroom operations. Each sensible feature 50 is comprised of a protrusion about 2.3 mm diameter by 3.2 mm high.

The invention has been described with reference to a preferred embodiment; however, it will be appreciated that a person of ordinary skill in the art can effect variations and modifications without departing from the scope of the invention.

PARTS LIST

1 Web
1' Photographic Web
2 Interior surface of web
21 Emulsion side surface
3 Exterior surface of web
3' Support side surface
4 Web end
5 Web end portion
6 Web-winding machine spindle
7 Web-winding machine spindle keyway
8 Web-winding machine spindle surface
9 Web-winding machine spindle key surfaces
10 Web-winding means
10' Injection molded web-winding means
12 Support structure
14 Outer web wrapping surface
15 Texture of web wrapping surface 14
16 Annular portion
17 Annular portion surface
18 Keyway
19 Keyway surface
20 Web tension
21 Web-winding machine applied torque
22 Static coefficient of friction for interior surface of web to web wrapping surface
23 Static coefficient of friction for interior surface of web to exterior surface of web
24 Cinching force
26 Cinching overlap
28 Deleterious particles
30 Web capture gate
32 Spindle rotation speed (w)
33 Web-winding speed (v)
40 Cored segment
42 Wall thickness, web wrapping surface
44 Wall thickness, annular portion surface
46 Support ribs
48 Support web
49 Wall thickness
50 Sensible feature
52 Web-winding machine mounting direction

What is claimed is:

1. An web-winding device for photographic film comprising a generally cylindrical support structure having an outer web wrapping surface for receiving at least one convolution of a web, an inner annular surface joined to said support structure for mating with a web-winding machine, wherein said inner annular surface has a wear rate coefficient of less than about $3.0\times10^{-7}$ $m^3/Nm$.

2. The web-winding device recited in claim 1 wherein said inner annular surface comprises a material having a composition including about 20 wt-% glass bead and polybutylene terphthalate.

3. The web-winding device recited in claim 1 wherein said inner annular surface comprises a thermoplastic polyester polybutylene terphthalate resin.

4. The web-winding device recited in claim 1 wherein said inner annular surface comprises a thermoplastic polyester resin blend having polybutylene terphthalate/polycarbonate (PBT/PC).

5. The web-winding device recited in claim 1 wherein said inner annular surface comprises a thermoplastic polyester resin blend having polybutylene terphthalate/polycarbonate-silicone copolymers (PBT/PC).

6. The web-winding device recited in claim 1 wherein said inner annular surface comprises a thermoplastic polyester amorphous polycarbonate (PC) resin.

7. The web-winding device recited in claim 6 wherein said thermoplastic polyester amorphous polycarbonate (PC) resin comprises a filler material of at least 2 wt.-% of a low-density polyethylene resin.

8. The web-winding device recited in claim 7 wherein said filler material comprises a material selected from the group consisting of: PTFE, low density polyethylene, silicone fluids, and fatty acid amides.

9. The web-winding device recited in claim 1 wherein said inner annular surface comprises modified amorphous thermoplastic polyester resin and modified amorphous thermoplastic polyester resin blends.

10. The web-winding device recited in claim 1 wherein said inner annular surface comprises semi-crystalline thermoplastic polyester resin and semi crystalline thermoplastic polyester resin blends.

11. The web-winding device recited in claim 1 wherein said generally cylindrical support structure has a tensile strength at 3.2 mm of about 52 MPa.

12. The web-winding device recited in claim 11 wherein said generally cylindrical support structure has a tensile elongation at 3.2 mm of about 200 percent.

13. The web-winding device recited in claim 12 wherein said generally cylindrical support structure has a flexural strength at 3.2 mm of at least 83 MPa.

14. The web-winding device recited in claim 13 wherein said generally cylindrical support structure has a flexural modulus at 3.2 mm of about 2,300 MPa.

15. The web-winding device of claim 14 wherein said inner annular surface comprises 4,4'-Di-tert-octyldiphenylamine.

16. The web-winding device recited in claim 14 wherein said inner annular surface comprises a thermoplastic polyester amorphous polycarbonate (PC) resin.

17. The web-winding device recited in claim 16 wherein said thermoplastic polyester amorphous polycarbonate (PC) resin comprises a filler material of at least 2 wt.-% of a low-density polyethylene resin.

18. The web-winding device recited in claim 12 wherein said generally cylindrical support structure has a Rockwell R hardness of about 117.

* * * * *